US009926175B2

(12) United States Patent
Maini et al.

(10) Patent No.: US 9,926,175 B2
(45) Date of Patent: Mar. 27, 2018

(54) AUXILIARY DEVICE FOR A CRANE AND CRANE COMPRISING SAID AUXILIARY DEVICE

(71) Applicant: CIFA SPA, Senago (MI) (IT)

(72) Inventors: Paolo Dario Maini, Monza (IT); Mauro Marco Cortellini, Rozzano (IT); Paolo Francesco Ragaini, Milan (IT)

(73) Assignee: CIFA SPA, Senago (MI) (IT)

( * ) Notice: Subject to any disclaimer, the term of this patent is extended or adjusted under 35 U.S.C. 154(b) by 210 days.

(21) Appl. No.: 14/511,244

(22) Filed: Oct. 10, 2014

(65) Prior Publication Data

US 2015/0102003 A1 Apr. 16, 2015

(30) Foreign Application Priority Data

Oct. 11, 2013 (IT) ..... MI2013A1680

(51) Int. Cl.
*B66C 23/70* (2006.01)

(52) U.S. Cl.
CPC ..... *B66C 23/70* (2013.01); *B66C 23/702* (2013.01)

(58) Field of Classification Search
CPC ..... B66C 23/70; B66C 23/702; B66C 23/62; B66C 23/64; B66C 23/701
USPC ..... 212/177
See application file for complete search history.

(56) References Cited

U.S. PATENT DOCUMENTS

RE27,763 E * 9/1973 Fauchere ..... B66C 23/702 212/168
3,830,376 A * 8/1974 Fritsch ..... B66C 23/707 212/350
6,516,962 B1 * 2/2003 Irsch ..... B66C 23/701 212/347
6,586,084 B1 * 7/2003 Paschke ..... B66C 23/701 212/348
8,857,567 B1 * 10/2014 Raymond ..... B66C 23/702 182/2.1
2011/0183094 A1 * 7/2011 Blomqvist ..... E04H 12/02 428/36.1
2011/0272378 A1 * 11/2011 Paschke ..... B66C 23/64 212/347
2015/0090850 A1 * 4/2015 Maini ..... B66C 23/68 248/284.1

FOREIGN PATENT DOCUMENTS

| | | |
|---|---|---|
| DE | 20305892 | 8/2003 |
| EP | 1090875 | 4/2001 |
| EP | 1361189 | 11/2003 |
| GB | 1221510 | 2/1971 |
| WO | WO 1996/26887 | 9/1996 |
| WO | WO 2012/156807 | 11/2012 |

OTHER PUBLICATIONS

European Search Report, dated Nov. 7, 2014 in the corresponding European application No. EP 14 18 8537, 8 pages.

* cited by examiner

*Primary Examiner* — Minh Truong
*Assistant Examiner* — Juan J Campos, Jr.
(74) *Attorney, Agent, or Firm* — Hamre, Schumann, Mueller & Larson, P.C.

(57) ABSTRACT

Auxiliary extension device for a crane provided with a telescopic extendable arm having at least one end segment provided with a free end, wherein the auxiliary extension device is made of one or more composite materials.

11 Claims, 3 Drawing Sheets

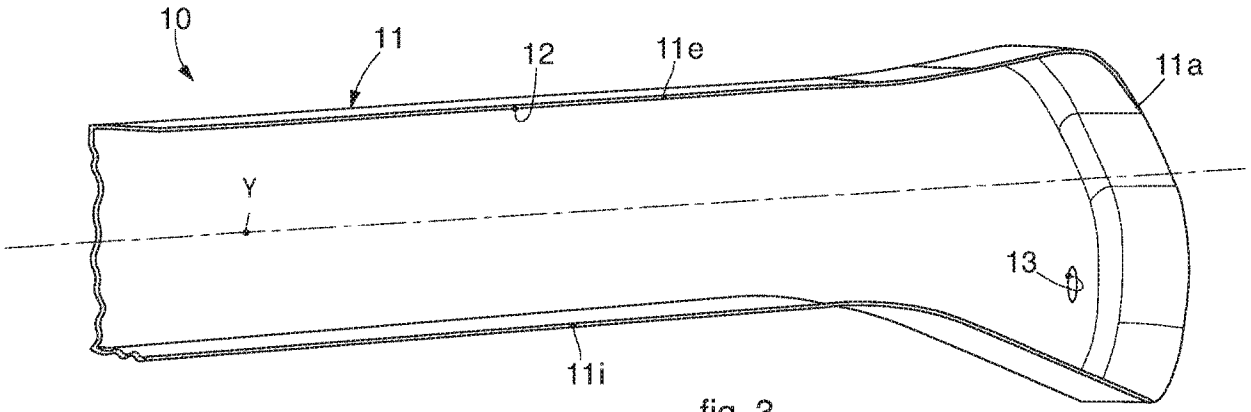
fig. 3
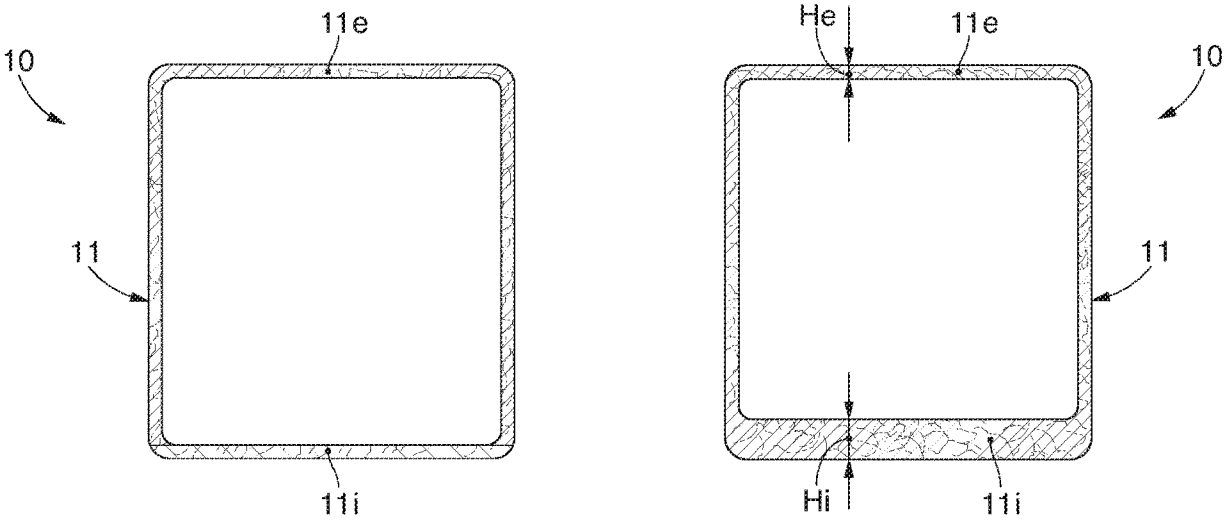
fig. 5
fig. 4

AUXILIARY DEVICE FOR A CRANE AND CRANE COMPRISING SAID AUXILIARY DEVICE

FIELD OF THE INVENTION

The present invention concerns an auxiliary extension device for a crane, and in particular a device applicable to one end of the main arm of the crane in order to increase the maximum height it can reach.

In particular, the present invention is applied in the field of telescopic cranes, that is, provided with a main arm that can be extended telescopically.

The present invention is applicable both to fixed cranes and to truck-mounted cranes, that is, those stably installed on a movement mean like a truck.

BACKGROUND OF THE INVENTION

It is known, in the construction industry, to use cranes, both fixed and truck-mounted, to move and lift weights, even hundreds of tons, to heights that can exceed several dozen meters.

Such cranes are normally provided with an extendable arm, which can be formed by one or more segments connected to each other in an articulated or telescopic manner. In the latter case they are called telescopic cranes, or extendable or telescopic arm cranes.

In some particular applications, in which supplementary performances are required of the crane, it is known to use, to increase the performance of the crane in terms of maximum reachable height, an auxiliary extension device, also known as jib, attached to the free end of the extendable arm. Normally, the auxiliary extension device is made of steel, and generally has a reticular latticed structure. The auxiliary extension device can be made with one or more segments or sections, connected or interconnected to each other.

Known auxiliary extension devices can be assembled by means of pivoting coupling on the free end of the corresponding extendable arm. This allows them to fold back on the extendable arm during transport, and then to be put in their working position, that is, cantilevered with respect to the extendable arm, by means of a rotation carried out on site.

Known auxiliary extension devices can be assembled and positioned both with manual procedures and also using a support crane.

One disadvantage of known auxiliary extension devices is that they are normally very heavy, even in the order of a ton. This can cause a heavier weight of the crane in its entirety, so that moving it by truck can be inconvenient and costly.

The weight of known auxiliary extension devices as above also penalizes the performance of the cranes in terms of the mass of movable load, since this must be added to the weight of the auxiliary extension device itself, already weighing on the extendable arm of the crane.

Another disadvantage connected to the weight of the auxiliary extension device can affect the horizontal distance to which the load can be moved, a distance which is connected to the forces acting on the attachment zone of the auxiliary extension device to the extendable arm of the crane.

Another limitation due to the weight of the auxiliary extension device affects the actual maximum height the arm can reach to position the load.

Another disadvantage of known auxiliary extension devices is connected to the complexity and time needed for the operations to assemble and produce the auxiliary extension devices themselves, since generally, as stated above, they have a latticed structure.

Another disadvantage of known auxiliary extension devices is that they are difficult to assemble on the end of the extendable arms of the cranes, since normally they need one or more support cranes.

It is also known from WO-A-96/26887, EO-A-2012/156807, EP-A-1.361.189, and EP-A-1.090.875 the use of segments of an extendable arm of a crane made with a composite material.

The documents WO-A-96/26887, WO-A-2012/156807 and EP-A-1.361.189, in particular, disclose an extendable arm in which, each segment is reciprocally connected to another segment and cannot be disassembled easily, without removing substantially parts of the extendable aim, such as actuation means able to move telescopically the segments.

The document WO-A-96/26887 discloses a crane for lifting a load, such as a platform. The crane comprises a telescopic aim formed by sections made of composites material. The sections cooperate with each other in sliding so as each section can slide internally or externally with respect to another section.

One of the sections, in particular the section defining the free end of the telescopic arm, is provided with an arm. The arm is also made with a composite material and is designed to support a platform to accommodate a load or people.

The arm has only the function of connection between the extendable arm and the platform, and is provided with regulation means configured to maintain the platform horizontal.

This arm, however, is not suitable to be connected to attachment devices, such as a hook to which a load can be attached.

One purpose of the present invention is to obtain an auxiliary extension device for a crane with an extendable arm which has a limited weight compared with known auxiliary extension devices, which is easy and quick to produce and which allows, given the same performance, to limit, the overall weight of the crane on which it is mounted.

Another purpose of the present invention is to simplify the selective connection operations between an auxiliary extension device and an extendable arm of a crane.

Another purpose of the present invention is to obtain an auxiliary extension device that has optimized mechanical resistance in relation to the stresses to which it is subjected.

Another purpose of the present invention is to obtain an auxiliary extension device for a crane with extendable arm that allows to increase the mass of load movable by the crane on which it is mounted, given the same height that can be reached.

Another purpose of the present invention is to obtain an auxiliary extension device which allows to increase the horizontal distance to which the load can be moved by the crane on whose extendable arm the auxiliary extension device is mounted, given the same mass of the load and the same length of the auxiliary extension device.

Another purpose is to obtain an auxiliary extension device which, given the same weight as a known auxiliary extension device, allows the crane on which it is mounted to reach a greater maximum height at which to position the load.

Another purpose of the present invention is to obtain an auxiliary extension device which, with the same sizes as a known auxiliary extension device, is easier to transport and easier to mount manually on the extendable arm of the crane and which does not need a support crane.

The Applicant has devised, tested and embodied the present invention to overcome the shortcomings of the state of the art and to obtain these and other purposes and advantages.

SUMMARY OF THE INVENTION

The present invention is set forth and characterized in the independent claims, while the dependent claims describe other characteristics of the invention or variants to the main inventive idea.

In accordance with the above purposes, an auxiliary extension device according to the present invention can be connected to a free end of an end segment of a telescopic extendable arm of a crane.

According to one aspect of the present invention, the auxiliary extension device has a first end configured to be connected to the free end of the end segment and a second end, opposite the first end and configured for connection of an attachment device for a load.

According to another aspect of the present invention, the auxiliary extension device is made of one or more composite materials with a fibrous structure defined by reinforcement fibers immersed in a polymeric matrix.

Making, the auxiliary extension device with one or more composite materials has the advantage of making it lighter and more manageable than a known auxiliary extension device made of steel, and allows to make it more easily and quickly, for example by molding.

According to another aspect of the present invention, the first end of the auxiliary extension device is provided with at least one connection element configured to selectively connect, in a releasable manner, and in a fixed manner the auxiliary extension device to the end segment.

In this way, the auxiliary extension device can be connect in a simply manner to the extendable arm, only when required by the specific operative situation.

In some forms of embodiment of the present invention, the fibers are chosen from a group comprising carbon, basalt and glass fibers, aramid fibers, polyethylene fibers, polyester-polyarylate fibers, or other polymeric materials with comparable mechanical properties.

According to the present invention, the one or more composite materials that the auxiliary extension device according to the present invention is made of include reinforcement fibers having resistance to traction greater than or equal to 2,500 MPa, in particular greater than or equal to 3,000 MPa, even more in particular greater than or equal to 3,500 MPa, and resistance to compression greater than or equal to 500 MPa, in particular greater than or equal to 1,000 MPa, more in particular greater than or equal to 2,000 MPa, even more in particular greater than or equal to 2,500 MPa.

According to another aspect of the present invention, the auxiliary extension device can be made of composite materials with a specific weight of less than at least 3 g/cm$^3$.

This advantageously allows to obtain an auxiliary extension device having mechanical characteristics equal to or greater than a known device made of steel, both using less material and also obtaining a relatively lighter structure which also lightens the crane in its entirety.

This relative lightness gives considerable advantages in terms of ease of movement and installation of the auxiliary extension device, and also in terms of increasing the performance of the crane, in the sense of quantity of load positionable, horizontal distance reachable given the same load.

Furthermore, an auxiliary extension device made with a material having low specific weight can be considerably longer, with the same weight and mechanical characteristics as a known auxiliary extension device made of steel, which gives the advantage for the crane of being able to reach greater heights.

In some formulations of the present invention, the auxiliary extension device has an oblong box-like shape defined by a perimeter wall which delimits at least one internal cavity and includes at least one lower portion, which, during use, faces toward a zone subtended by the extendable arm, and an upper portion, opposite the lower portion.

The box-like shape advantageously allows to reduce the tunes and hence the costs of making the device according to the invention.

Furthermore, according to one aspect of the present invention, the lower portion is configured to have a greater resistance to compression than the upper portion.

Another aspect of the invention provides that the upper portion is configured to have a greater resistance to traction than the lower portion.

In this way, we advantageously obtain an auxiliary extension device for the extendable arm of the crane which is optimized to support the stresses to which it is subjected during normal use, that is, traction stresses to the extrados and compression stresses to the intrados.

In some forms of embodiment of the present invention, the upper portion of the perimeter wall is made of a composite material with a rigid fiber and the lower portion is made of a composite material with a flexible fiber. The composite material with a flexible fiber comprises fibers having an elastic module which is less than that of said composite material with a rigid fiber.

According to one embodiment, the fibers of the composite material with a rigid fiber have an elastic module comprised between about 180 GPa and about 300 GPa, in particular between about 200 GPa and about 260 GPa, and the fibers of said composite material with a flexible fiber have an elastic module comprised between about 150 GPa and 250 GPa, in particular between about 170 GPa and about 220 GPa.

According to another aspect of the present invention, the lower portion has a thickness which is greater than the thickness of the upper portion.

In this way, by means of the differentiated choice of materials and/or sizes of the lower and upper portions, it is possible to optimize, based on specific requirements, the behavior of the auxiliary extension device according to the invention with respect to the stresses to which it is normally subjected, that is, compression stresses to the intrados, or lower part and traction stresses to the extrados, or upper part.

In some implementations of the present invention, the auxiliary extension device comprises one or more segments having an oblong box-like shape, reciprocally interconnected, made entirely of one or more composite materials. A first of said segments defines the first end and a second of said segments defines said second end.

In one embodiment the two or more segments are configured to slide one inside the other in a telescopic manner to define at least one operating condition of the auxiliary extension device, in which the segments are aligned with respect to each other in an extended conformation, and a non-operating condition in which the segments are retracted one inside the other.

These solutions have the advantage that they confer surprising compactness on the auxiliary extension device during the non-operating steps, for example during transport, and also advantageously allow to pass easily from the operating condition to the non-operating condition and vice versa.

The present invention also concerns a telescopic extendable arm at the free end of whose end segment an auxiliary device is connected, and a crane comprising said telescopic extendable arm.

BRIEF DESCRIPTION OF THE DRAWINGS

These and other characteristics of the present invention will become apparent from the following description of some forms of embodiment, given as a non-restrictive example with reference to the attached drawings wherein:

FIG. 3 is a partly three-dimensional view, in section, of one form of embodiment of the auxiliary extension device in FIG. 2;

FIG. 4 is a cross section of the auxiliary extension device in FIG. 3;

FIG. 5 is a variant of FIG. 4;

In the following description, the same reference numbers indicate identical parts of the auxiliary extension device and truck-mounted crane according to the present invention, even in different forms of embodiment. It is understood that elements and characteristics of one form of embodiment can conveniently be incorporated into other forms of embodiment without further clarifications.

DETAILED DESCRIPTION OF SOME FORMS OF EMBODIMENT

We shall now refer in detail to the various forms of embodiment of the present invention, of which one or more examples are shown in the attached drawings. Each example is supplied by way of illustration of the invention and shall not be understood as a limitation thereof. For example, the characteristics shown or described insomuch as they are part of one form of embodiment can be adopted on, or in association with, other forms of embodiment to produce another form of embodiment. It is understood that the present invention shall include all such modifications and variants.

Figure 1:
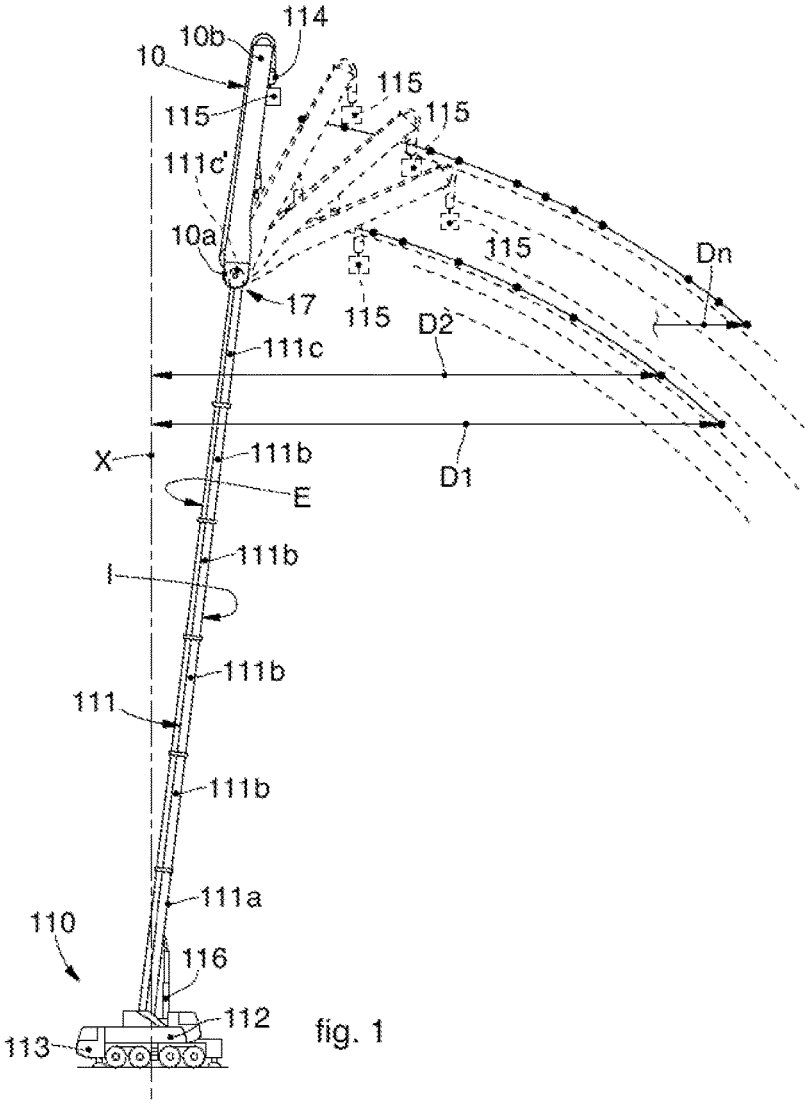
FIG. 1 is a schematic lateral view of a truck-mounted crane with a telescopic arm on which an auxiliary extension device according, to the present invention is mounted.

FIG. 1 is used to describe possible forms of embodiment in which an auxiliary extension device 10 according to the present invention is mounted on a truck-mounted crane or truck crane 110.

The truck crane 110 can include a telescopic arm 111 provided with a plurality of segments 111*a*, 111*b*, 111*c*, sliding one inside the other, able to be linearly extended to assume an extended operating condition, or retracted one inside the other in a non-operating condition or downtime, for example during transport.

Hereafter in the description we shall refer to a truck crane 110 merely by way of example, but the following considerations shall be valid for any crane whatsoever, fixed or truck-mounted, provided with a telescopic extendable arm.

The segments of the extendable arm 111 can be divided into base segments 111*a*, intermediate segment/segments 111*b*, and end segment 111*c*. In the specific case shown by way of example in FIG. 1, as well as the base segment 111*a* and the end segment 111*c*, the extendable arm 111 also includes four intermediate segments 111*b*.

The base segment 111*a* can be connected for example pivoted to a maneuver base 112, in turn mounted on a truck 113 and conventionally rotatable around a vertical axis X.

The vertical axis X can pass through the pivoting zone of the base segment 111*a* to the maneuver base 112.

The extendable arm 111 can be inclinable with respect to the vertical axis X, to make a load 115 reach desired horizontal distances.

The horizontal distances are measured with respect to said vertical axis X.

The inclination of the extendable arm 111 can be commanded in a known manner by means of a linear actuator 116, for example hydraulic, having one end connected to the maneuver base 112 and the opposite end connected to the base segment 111*a*.

During the use of the truck crane 110, the extendable arm 111 is never parallel to the vertical axis X, and can assume at most a position of minimum inclination. Therefore, it is always possible to define an intrados zone I, or lower zone, subtended by the extendable arm 111, and an extrados zone E, or upper zone, opposite the extendable arm 111 with respect to the intrados zone I.

The auxiliary extension device 10 can include a first end 10*a* configured to be selectively connected, in a fixed manner, to a free end 111*c*' of the end segment 111*c* of the extendable arm 111.

The auxiliary extension device 10 can also include a second end 10*b*, opposite the first end 10*a* and configured to connect an attachment device 114 to which a load 115 can be attached.

The auxiliary extension device 10 can be rotatably connected to the end segment 111*c* of the extendable arm 111, so that it can rotate with respect to its first end 10*a*.

According to one embodiment, at least one between the auxiliary extension device 10 and the end segment 111*c* of the extendable arm III can be provided with an orientation element 17 configured to allow the angular positioning of the auxiliary extension device 10 with respect to the extendable arm 111.

FIG. 1 is used to illustrate possible positions of the auxiliary extension device 10, which can assume a reference position, in which it is aligned with the extendable arm 111, and a plurality of operating positions, in which the auxiliary extension device 10 is inclined with respect to said reference position.

In the specific case of FIG. 1, by way of example, three operating positions are shown, in which the auxiliary extension device 10 is inclined respectively by 20°, 40° and 60' with respect to the reference position defined by the position of the extendable arm 111.

FIG. 1 shows, by way of example, some maximum horizontal distances that can be reached by the load 115 for different entities of the mass of the load and for different inclinations of the extendable arm 111.

The maximum horizontal distances are indicated in FIG. 1 by the alphanumerical references $D_1$, $D_2$ . . . , $D_n$ and are measured starting from the vertical axis X.

Figure 2:
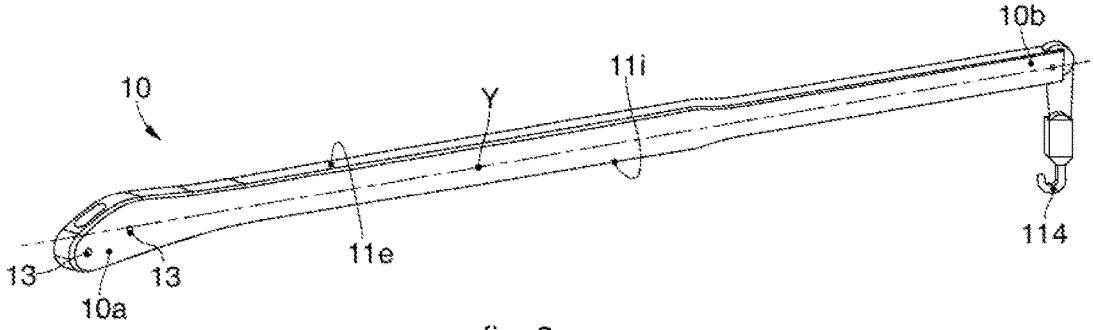
FIG. 2 is a three-dimensional view of the auxiliary extension device in FIG. 1.

FIG. 2 is used to describe possible forms of embodiment of the auxiliary extension device 10 in which it has an oblong shape and a main development along a longitudinal axis Y which joins the first end 10*a* and the second end 10*b*.

The first end 10*a* can be provided with one or more connection elements 13 configured to selectively connect, in a releasable manner, and in a fixed manner, the end segment 111*c* of the extendable arm 111.

According to one embodiment the connection elements 13 can cooperate with, or can have the function of the orientation element 17.

The connection means can be chosen in a group comprising at least a hole 13 (FIG. 1), a pin, a screw, a peg, a flange, a plate.

According to one embodiment (FIG. 1) the first end 10*a* can be provided with a plurality of holes 13, in this case two holes 13. The two holes 13 are made, in the first end 10*a*, distanced to each other along the extension of the auxiliary extension device 10, and in proximity of said first end 10*a*. In this way, the auxiliary extension device 10 can be selectively fixed to the end of the extendable arm 111 and the rotation of the auxiliary extension device 10 can be prevented.

According to another embodiment, the holes 13 are made through the thickness of the auxiliary extension device 10.

Said attachment can be achieved directly by means of screws, pins or other attachment members, or it can be provided to interpose elements to reinforce and stabilize the connection, such as for example plates, flanges or other.

The attachment device 114 can be connected to the second end 10*b*.

The auxiliary extension device 10 can be made of composite material, for example with a fibrous structure comprising reinforcement fibers with high mechanical resistance incorporated in a polymeric matrix.

By way of example, the fibers can be carbon, basalt and glass fibers, or one or more polymer materials, for example aramid fibers, polyethylene fibers, or polyester-polyarylate fibers, or other polymeric materials also known as technopolymers.

The composite material that the auxiliary extension device 10 is made of can contain reinforcement fibers having mechanical resistance to traction greater than or equal to 2,500 MPa, even up to 3,500 MPa or more, and mechanical resistance to compression that can be greater than or equal to 2,800 MPa, and therefore both greater than those of low-alloy steels, or construction steels, normally used for making known auxiliary extension devices with a latticed structure.

In one case given by way of example, the material used can be a composite material containing carbon fibers having resistance to traction of 3,530 MPa.

The reinforcement fibers can confer on the composite material that makes up the auxiliary extension device 10 mechanical resistance to traction comprised between 1,500 MPa and 6,000 MPa, therefore about 4 to about 15 times that of low-alloy construction steels, for which said resistance is generally comprised between 350 MPa and 550 MPa.

Furthermore, the density of the glass and basalt fibers is about 2.5-2.8 g/cm$^3$, therefore about ⅓ of the average density of steel (7.6-8.0 g/cm$^3$), whereas the technopolymers cited above have a density of about 1.5 g/cm$^3$, therefore about ⅕ of the average density of steel.

It is therefore possible to make auxiliary extension devices 10 considerably more resistant than those currently in use, made of construction steel.

Furthermore, given the same mechanical resistance, using composite materials it is possible to obtain considerably lighter auxiliary extension devices 10.

In fact, the resistance/weight ratio of composite materials can even be 40 times more than that of low-alloy construction steels.

Merely by way of example, a 14-meter long auxiliary extension device 10 made with composite material based on carbon fibers can weigh about 250-300 kg, whereas a standard auxiliary extension device of the same length can weigh between about 800 kg and 900 kg, with a difference comprised between 500 kg and 600 kg.

This difference, in absolute terms, varies according to the sizes of the auxiliary extension device 10, however in percentage terms it can be comprised between about 30% and about 400% of the weight of the auxiliary extension device 10.

Consequently, with the same performance of the truck crane 110, the latter is lighter if provided with an auxiliary extension device 10 according to the present invention compared with a standard auxiliary extension device.

Furthermore, an auxiliary extension device 10 made of composite material, being relatively light, is easily movable and transportable.

Moreover, the relative lightness conferred on the auxiliary extension device 10 by adopting a composite material to make it, allows to speed up and simplify the operations to assemble it to the end segment 111*c* of the extendable arm 111.

In particular, the reduced weight of the auxiliary extension device 10 can allow to perform assembly operations exclusively, or almost exclusively, manually, thus allowing to reduce or eliminate the need to use one or more support cranes, as happens instead in most known cases. In fact, in the state of the art, manual assembly is used only for smaller auxiliary extension devices, and therefore is not applied in the usual construction contexts.

On the contrary, an auxiliary extension device 10 made of composite material, even with a considerable length, can be moved and lifted, even if only partly, by operators who can assemble it manually to the end segment 111*c*.

It is clear that limiting the weight of the auxiliary extension device 10 by using lighter materials than those commonly used allows to increase the performance of the truck crane 110 in terms of size of the movable mass of the load 115. Said mass can in fact be increased, compared with the mass movable using a standard auxiliary extension device, precisely by the difference in weight between the auxiliary extension device 10 made of composite material and a standard auxiliary extension device of the same length but made of steel.

FIG. 2 is used to describe forms of embodiment in which the auxiliary extension device 10 is made entirely or almost entirely of a composite material, and has a shape defined by a single segment having the first end 10*a* to connect to the extendable arm 111 and the second end 10*b*, to which the attachment device 114 is connected.

In variant forms of embodiment, in correspondence with the first end 10*a* and/or the second end 10*b* of the auxiliary extension device 10, metal reinforcement inserts can be provided, drowned in the structure of the composite material and with the function of giving greater strength and solidity to the connection of the auxiliary extension device 10 to the end segment 111*c* of the extendable arm 111 and/or to reinforce the zone supporting the load 115.

In possible implementations, the auxiliary extension device 10 can have a constant height along the longitudinal axis V.

In other implementations, it may also be provided that said height is variable along the longitudinal axis Y, for example reducing from the first end 10*a* to the second end 10*b* (FIG. 2).

FIG. 3 is used to describe forms of embodiment in which the auxiliary extension device 10 has a box-like shape. In this way it is possible to reduce the weight of the auxiliary extension device 10 and of the extendable arm 111. In one embodiment the auxiliary extension device 10 has a tubular shape. In this embodiment the cross section of the auxiliary extension device 10 can be square, rectangular, or in general polygonal.

The box-like shape of the auxiliary extension device 10 can be advantageously obtained using techniques for molding the composite materials, such as those with a male or female mold.

This facilitates and reduces the production times of the auxiliary extension device 10, which can be obtained with a limited number of operating steps, considerably reduced compared with those needed to make a latticed structure, which requires a large number of weldings.

Furthermore, given the same volume and the same mechanical properties, a box-like structure made of composite material is lighter than a steel latticed structure.

Moreover, by using composite materials to make the auxiliary extension device 10, the shape of the latter is not constrained by limitations connected to constructional and design requirements.

With reference to FIG. 3, the box-like shape of the auxiliary extension device 10 is defined by a perimeter wall 11 that delimits an internal cavity 12.

The perimeter wall 11 can include a first end portion 11*a* and a second end portion 11*b* (the latter not shown in the drawing), which respectively define the shape of the first end 10*a* and the second end 10*b* of the auxiliary extension device 10.

The perimeter wall 11 can also include an lower portion 11*i* which during use faces toward the intrados zone I subtended by the extendable arm 111, and an upper portion 11*e* which during use faces toward the extrados zone E.

The lower 11*i* and upper 11*e* portions are reciprocally opposite with respect to the longitudinal axis Y along which the auxiliary extension device 10 develops.

The lower portion 11*i* is configured to support, during use, compression stresses due to the flexion to which the auxiliary extension device 10 is subjected due to the effect of the load 115 at its second end 10*b*.

The upper portion 11*e* is configured to support, during use, traction stresses due to the flexion to which the auxiliary extension device 10 is subjected due to the effect of the load 115.

Using the auxiliary extension device 10 as an extension of the telescopic extendable arm 111 of a truck crane 110 has the effect of subjecting the lower 11*i* and upper 11*e* portions always to the same type of stresses, that is, compression and traction stresses respectively.

The auxiliary extension device 10 is configured with lower 11*i* and upper 11*e* portions optimized to resist said stresses.

In particular, the lower portion 11*i* is configured to have greater resistance to compression than the upper portion 11*e*, whereas the latter is configured to have greater resistance to traction than the lower portion 11*i*.

Some forms of embodiment of the auxiliary extension device 10, described by way of example with the aid of FIGS. 3 to 5, can provide a perimeter wall 11 that can have a constant (FIGS. 3 and 4) or variable thickness (FIG. 5).

Some forms of embodiment described using FIG. 4 can provide to use different composite materials, chosen among those described above, to confer on the auxiliary extension device 10 a heterogeneous internal structure.

For example, it may be provided to make the upper portion 11*e* of the perimeter wall 11 of the auxiliary extension device 10 with a composite material of rigid fiber, and the lower portion 11*i* with a composite material of flexible fiber.

By composite material of rigid fiber we mean a material containing fibers having a high elastic module, in particular comprised between 180 GPa and 300 GPa which, in the case given by way of example of material containing carbon fibers, can be about 230 GPa.

By composite material of flexible fiber we mean a material containing fibers with an elastic module which is less than that of the composite materials with a rigid fiber, preferably comprised between 150 GPa and 250 GPa, in particular between 170 GPa and 220 GPa, and greater toughness.

Using different materials between the lower portion 11*i* and the upper portion 11*e*, in particular materials with a different behavior with respect to compression and traction, can confer on the lower portion 11*i* a desired resistance to compression greater than that of the upper portion 11*e*, and to the upper portion 11*e* a desired resistance to traction greater than that of the lower portion 11*i*.

It should be noted that also a heterogeneous structure of the auxiliary extension device 10, if defined by two or more composite materials, can be obtained with a single molding operation, therefore the choice of the composite materials to be used is made free and unlimited.

FIG. 5 is used to describe possible forms of embodiment of the auxiliary extension device 10, combinable with all the forms of embodiment described here, in which the lower portion 11*i* has a thickness Hi greater than the thickness He of the upper portion 11*e*.

The greater thickness Hi of the lower portion 11*i* is intended to confer greater resistance on the auxiliary extension device 10, stabilizing in the lower portion 11*i* the section resistant to compression stresses and thus allowing to move a bigger load 115 and with greater safety.

In some implementations, the thickness Hi can be comprised between 101% and 200% of the thickness He, for example between 105% and 150%, in particular solutions between 105% and 120% of the thickness He.

Possible forms of embodiment can provide to use a single composite material both for the lower portion 11*i* and for the upper portion 11*e*, or different composite materials for the two portions 11*i*, 11*e*, chosen from those described above.

The criteria for the choice take into account design requirements and the operating end use of the auxiliary extension device 10.

Figure 6:
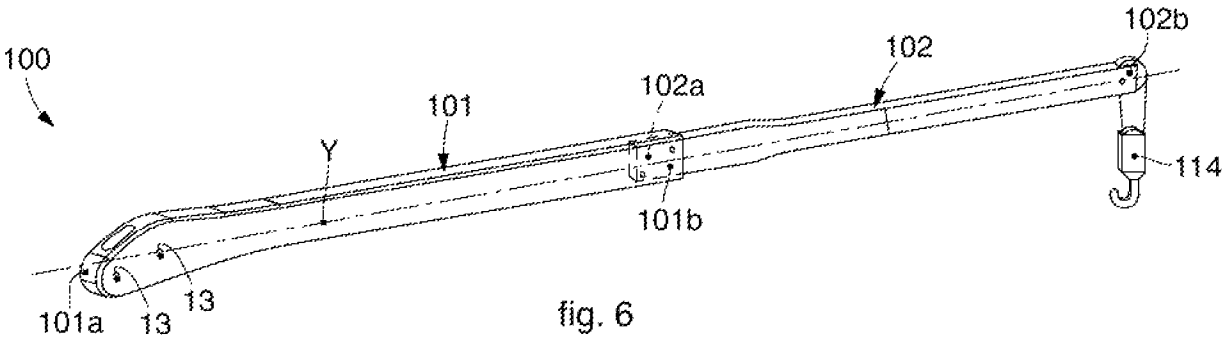
FIG. 6 is a three-dimensional view in section of another form of embodiment of the auxiliary extension device in FIG. 2, in an operating condition.
Figure 7:
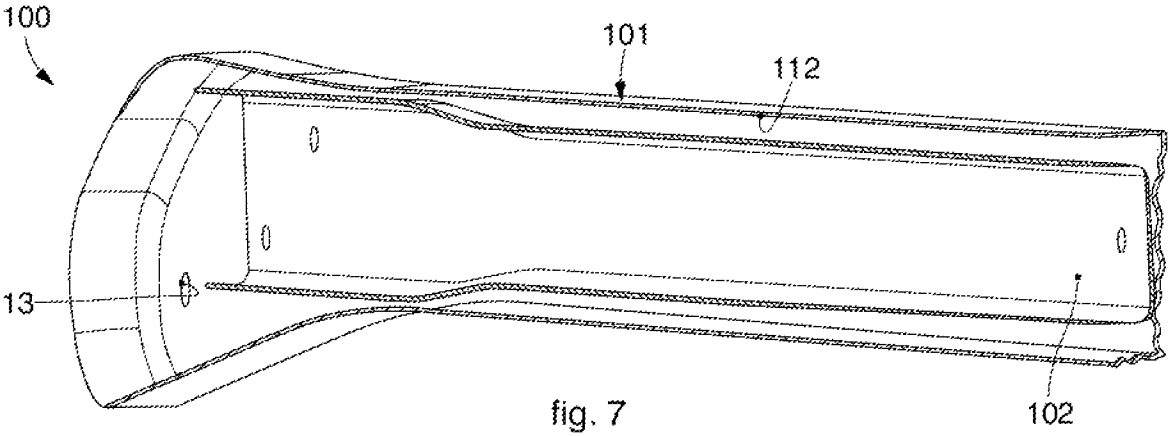
FIG. 7 is a partly sectioned view of the auxiliary extension device in FIG. 6 in a non-operating condition.

FIGS. 6 and 7 are used to describe forms of embodiment in which an auxiliary extension device 10 is made with one or more composite materials as described above, and is defined by a plurality of segments, reciprocally interconnected.

In these forms of embodiment, the segments can be configured to make the auxiliary extension device 100 assume at least an operating condition (FIG. 6) in which the segments are aligned with each other consecutively along the longitudinal axis Y, and a non-operating condition (FIG. 7), in which the segments are grouped together, collected, folded or overlapping, to define a minimum extension of the auxiliary extension device 100.

In particular, FIG. 7 is used to describe forms of embodiment in which the auxiliary extension device 100 is the telescopic type, in which the segments have a box-like shape and can be retracted inside each other.

In the specific case shown by way of example in FIG. 6, the auxiliary extension device 100 can include two segments, that is, a first segment 101 and a second segment 102.

The first segment 101 can have an attachment end 101*a*, configured to connect to the free end 111*c*' of the end segment 111*c* of the extendable arm 111, and a connection end 101*b*, opposite the attachment end 101*a*.

The connection end 101*b* is configured to connect with a corresponding connection end 102*a* of the second segment 102.

The second segment 102 can be provided with an attachment end 102*b*, opposite the connection end 102*a* and to which the attachment device 114 can be connected in a known manner.

FIG. 6 is used to describe an operating condition of the auxiliary extension device 100, in which the first segment 101 and the second segment 102 are aligned along the longitudinal axis Y.

FIG. 7 is used to describe a non-operating condition of the auxiliary extension device 100, in which the second segment 102 is entirely contained inside an internal cavity 112 of the first segment 101.

In this way, the bulk of the auxiliary extension device 100 in said non-operating condition is minimum, which makes movement and transport easy.

The ease of transport is also increased by the lightness of the auxiliary extension device 100, since it is made entirely or almost entirely of composite materials.

It is clear that modifications and/or additions of parts may be made to the auxiliary extension device and the truck crane as described heretofore, without departing from the field and scope of the present invention.

Indeed, it is understood that the reference to the auxiliary extension device 100, which is provided with two segments 101, 102, has a value merely by way of example of a possible implementation of the present invention, and that a larger number of segments may be provided without departing from the field of protection defined herein.

It is also clear that, although the present invention has been described with reference to some specific examples, a person of skill in the art shall certainly be able to achieve many other equivalent forms of auxiliary extension device and truck crane, having the characteristics as set forth in the claims and hence all coming within the field of protection defined thereby.

The invention claimed is:

1. An auxiliary extension device for a crane, wherein the crane includes a telescopic extendable arm having at least one end segment provided with a free end, the auxiliary extension device comprising:

a first end configured to be connected to said free end and a second end, opposite said first end and configured for connection of an attachment device for a load, wherein said auxiliary extension device is made of one or more composite materials with a fibrous structure defined by reinforcement fibers immersed in a polymeric matrix, and said first end is provided with a plurality of holes, said holes being made distanced to each other along an extension of the auxiliary extension device, and in proximity of said first end, wherein said holes are configured to selectively connect, the auxiliary extension device to the end segment in a desired angular position with respect to the extendable arm and in such a way that the rotation of the auxiliary extension device with respect to the extendable arm is prevented; and an oblong box shape defined by a perimeter wall which delimits at least one internal cavity, said perimeter wall comprising at least one lower portion, which, during use, faces toward a zone subtended by the extendable arm, and an upper portion, opposite said lower portion, and wherein said lower portion has a thickness which is greater than a thickness of said upper portion, and said lower portion is configured to support, during use, compression stresses, and said upper portion is configured to support, during use, traction stresses, the upper portion of the perimeter wall is made of a composite material with a rigid fiber, and the lower portion of the perimeter wall is made of a composite material with a flexible fiber, wherein the composite material with the flexible fiber comprises fibers having an elastic modulus which is less than that of the composite material with the rigid fiber.

2. The auxiliary extension device as in claim 1, wherein said fibers of said composite material with a rigid fiber have an elastic modulus comprised between 180 GPa and 300 GPa and said fibers of said composite material with a flexible fiber have an elastic modulus comprised between 150 GPa and 250 GPa.

3. The auxiliary extension device as in claim 1, wherein said fibers are chosen from a group comprising carbon, basalt and glass fibers, aramid fibers, polyethylene fibers, polyester-polyarylate fibers, or other polymeric materials with comparable mechanical properties.

4. The auxiliary extension device as in claim 1, wherein said one or more composite materials comprise fibers having resistance to traction greater than or equal to 2,500 MPa and resistance to compression greater than or equal to 500 MPa.

5. The auxiliary extension device as in claim 1, wherein said one or more composite materials have a specific weight of less than 3 g/cm$^3$.

6. The auxiliary extension device as in claim 1, further comprising two or more segments having an oblong box shape, reciprocally interconnected, made entirely of one or more composite materials, a first of said segments defining said first end and a second of said segments defining said second end.

7. The auxiliary extension device as in claim 6, wherein said two or more segments are configured to slide one inside the other in a telescopic manner to define at least an operating condition of said auxiliary extension device, wherein said segments are aligned with respect to each other in an extended conformation, and a non-operating condition of said auxiliary extension device, wherein said segments are retracted one inside the other.

8. The combination of a telescopic extendable arm for a crane and an auxiliary extension device as in claim 1, wherein said telescopic extendable arm comprises at least one end segment having a free end to which said auxiliary extension device is connected.

9. The crane comprising a telescopic extendable arm having at least one end segment provided with a free end to which an auxiliary extension device, as in claim 1, is connected, at least said auxiliary extension device being made of one or more composite materials with a fibrous structure defined by reinforcement fibers immersed in a polymeric matrix.

10. The auxiliary extension device as in claim 1, wherein at least one between the auxiliary extension device and the end segment of the extendable arm is provided with an orientation element configured to allow the angular positioning of the auxiliary extension device with respect to the extendable arm.

11. The auxiliary extension device as in claim 1, wherein the thickness of the lower portion is from 101% to 200% of the thickness of the upper portion.

* * * * *